US009358550B2

(12) United States Patent
Urick

(10) Patent No.: US 9,358,550 B2
(45) Date of Patent: Jun. 7, 2016

(54) BLACK SAND MAGNETIC SEPARATOR

(71) Applicant: David Urick, Camas, WA (US)

(72) Inventor: David Urick, Camas, WA (US)

( * ) Notice: Subject to any disclaimer, the term of this patent is extended or adjusted under 35 U.S.C. 154(b) by 0 days.

(21) Appl. No.: 14/545,860

(22) Filed: Jun. 30, 2015

(65) Prior Publication Data

US 2016/0121341 A1 May 5, 2016

Related U.S. Application Data

(60) Provisional application No. 62/074,328, filed on Nov. 3, 2014.

(51) Int. Cl.
*B03C 1/00* (2006.01)
*B03C 1/23* (2006.01)

(52) U.S. Cl.
CPC ..... *B03C 1/23* (2013.01)

(58) Field of Classification Search
CPC ..... B03C 1/00; B03C 1/10; B03C 1/12; B03C 1/23; B03C 1/30
USPC ..... 209/10, 212, 224, 225
See application file for complete search history.

(56) References Cited

U.S. PATENT DOCUMENTS

| | | | | | |
|---|---|---|---|---|---|
| 954,015 | A | | 4/1910 | Bent | |
| 3,172,516 | A | * | 3/1965 | Moore | H01R 43/033 192/12 C |
| 3,319,093 | A | * | 5/1967 | Abdul | H02K 5/132 15/28 |
| 3,519,858 | A | * | 7/1970 | Morganson | B23B 45/008 310/154.08 |
| 4,416,771 | A | | 11/1983 | Henriques | |
| 4,512,881 | A | * | 4/1985 | Shumway | B03B 5/56 209/270 |
| 4,743,364 | A | | 5/1988 | Kyrazis | |
| 5,063,796 | A | * | 11/1991 | Gennep | B25B 17/00 362/120 |
| 5,632,720 | A | * | 5/1997 | Kleitz | A61N 2/00 600/9 |
| 6,138,833 | A | | 10/2000 | Matsufuji | |
| 8,684,185 | B2 | | 4/2014 | Ries | |
| 2013/0313926 | A1 | * | 11/2013 | Bekavac | H02K 7/145 310/50 |

* cited by examiner

*Primary Examiner* — Terrell Matthews
(74) *Attorney, Agent, or Firm* — Randal D. Homburg

(57) ABSTRACT

A primary ore separation device used to remove magnetic particles from non-magnetic particles in a mixture utilizes a spinning magnet within a non-conductive cylindrical tube attaching the magnetic particles to the tube while the magnet is spinning and, by using centrifugal force, or the force caused by inertia, separates and spins away the non-magnetic particles, the device generally used upon mixed ore materials containing gold and other precious metals contained within the non-magnetic particles.

8 Claims, 4 Drawing Sheets

BLACK SAND MAGNETIC SEPARATOR

CROSS REFERENCE TO RELATED APPLICATIONS

Applicant claims the benefit of Provisional Patent No. 62/074,328, filed on Nov. 3, 2014, by the same inventor, David Urick.

I. BACKGROUND OF THE INVENTION

1. Field of Invention

A primary ore separation device used to remove magnetic particles from non-magnetic particles in a mixture utilizes a spinning magnet within a non-conductive cylindrical tube attaching the magnetic particles to the tube while the magnet is spinning and, by using centrifugal force, or the force caused by inertia, separates and spins away the non-magnetic particles, the device generally used upon mixed ore materials containing gold and other precious metals contained within the non-magnetic particles.

2. Description of Prior Art

A preliminary review of prior art patents was conducted by the applicant which reveal prior art patents in a similar field or having similar use. However, the prior art inventions do not disclose the same or similar elements as the present magnetic separator, nor do they present the material components in a manner contemplated or anticipated in the prior art.

Magnetic separation of ore has been used for ore suspended is liquids or for the application to dry ores materials. In U.S. Pat. No. 954,015 to Bent, an auger compels a stream of liquid bearing ore through a horizontal tube with a magnet drawing the magnetic particles laterally where the magnetic particles are evacuated in a descent while the tailings in the suspension are carried upward by an upward flowing stream. A vertical separator sifts ore through a mesh screen where the particles fall into an upper cylinder into a liquid within the tube pushed by an eddy current within the tube influenced by a DC biased current and forces the particles into lateral multiple ore extractors which gather the metallic ores and extract them based upon their distinct permeability and ohmic resistance. See U.S. Pat. No. 4,416,771 to Henriquez. The cores are charged with an alternating current of variable frequencies. "Influenced particles" are moved aside while "uninfluenced particles" continue downward into the bottom of the vertical tube. A similar liquid suspension separator is shown in U.S. Pat. No. 8,684,185 to Ries which uses a magnetic coil to influence magnetic particles away from non-magnetic particle within a mixture of magnetic and non-magnetic particles within the liquid suspension.

U.S. Pat. No. 4,743,364 to Kyrazis runs a mixed power by means of a belt drive through a magnetic field, wherein the magnetic particles are lifted into an upper passage while a lower passage evacuates the non-magnetic particle not influenced by the magnetic field.

Rotation has also been used in the separation of metallic ores. In U.S. Pat. No. 6,138,833 to Matsufuji, a method is defined which utilizes centrifugal force provided by an air jet pump to move placer gold sand particles through a pipe and removing the particles through the specific gravity distinctions of the particles and separating the placer gold from the other particles through a magnetized cylinder with a high magnetic field, between 5000 and 200,00 gauss, against an inner wall of the magnetized cylinder. A much more simple rotating cylinder is shown in U.S. Pat. No. 4,512,881 to Shumway, which is a simple rotating drum cylinder with an inner spiral auger with large particles sent down the rotating drum while the smaller gold containing black sands are released through a plurality of small openings in the drum allowing the black sand to be separated from the more course materials in the materials run through the drum. A vibrating cradle is also employed within the machine.

A rotating magnetic wand is demonstrated in an unrelated massage device to Kleitz, U.S. Pat. No. 5,632,720, which discloses a wand with an inner rotating magnet which emits an series of magnetic waves which allegedly enhance vascular circulation when held over a body part between 18 and 24 inches away from the body part. Although used in a wholly unrelated filed of art, it does include a wand with a rotating magnet within the wand.

II. SUMMARY OF THE INVENTION

Black sand gold mining has grown in popularity due to the recent increase in the price of gold and the development of less expensive technology for the part time prospector and enthusiast. Black sands are found in several geographic locales across the globe, primarily in places containing placer deposits or on beaches near prior volcanic activity. The black sands are known to contain precious metals including gold, thorium, titanium, tungsten, and zirconium, and gemstones including garnet, topaz, ruby, sapphire, and diamonds. Due to the increase in the occasional prospectors, large scale placer mining has been restricted, commonly requiring a license or permit near lakes, rivers and streams and especially on public beaches. Small scale or hobby scale mining has also been recently restricted or limited to small quantity mining and often away from the water where the black sands are know to deposit.

As seen in the prior art, using a magnet for primary separation of magnetic deposits from non-magnetic materials has been known in the field of placer mining of black sands. However, none of the prior art provides a magnetic separator using the simple components and mechanical features of the present magnetic separator.

The primary objective of the invention is to provide a simple device attaching to a common drill which attracts magnetic materials comprising black sands and, by use of a spinning motion, causes the non-magnetic particles to be forcibly removed from the spinning magnetic material by inertia and/or centrifugal force. A second objective is to provide the device with the ability to withdraw the magnetic force from the pick-up end of the device to remove the magnetic material from the pick-up end once the non-magnetic materials are removed, repeating the magnetic separation until a satisfactory separation has occurred, wherein the non-magnetic materials are removed for further classification and separation. It can be presented as a hand held tool for use with a rotary drill, as seen in below FIG. 1, or in an industrial size with other drive means and incorporated as a component in industrial sized applications and machinery where separation of magnetic particles is desire and useful.

III. DESCRIPTION OF THE DRAWINGS

The following drawings are submitted with this utility patent application.

IV. DESCRIPTION OF THE PREFERRED EMBODIMENT

Figure 1:
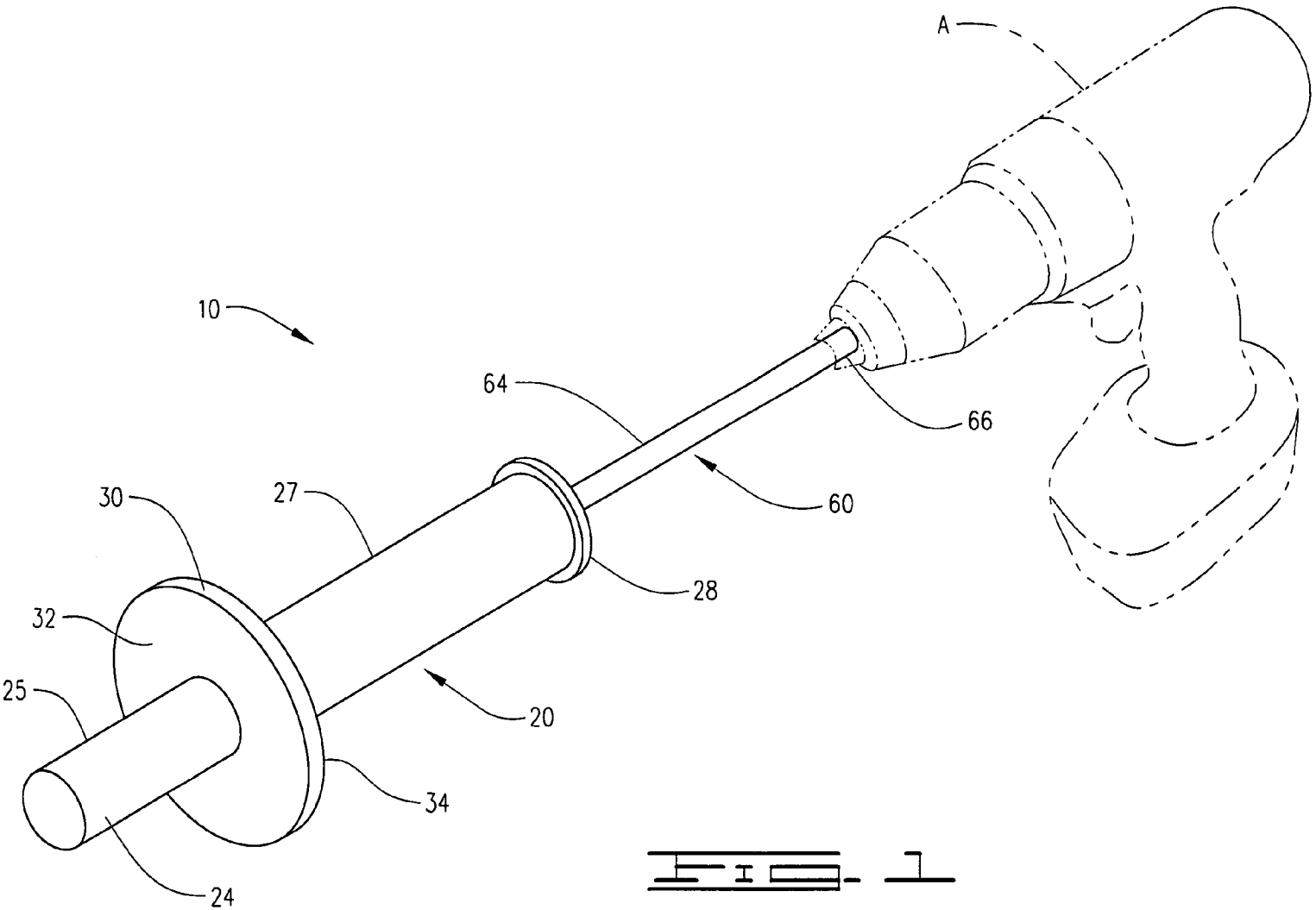
FIG. 1 is a perspective view of the magnetic separation device with phantom lines showing the attachment of the device to a cordless rotary drill.
Figure 2:
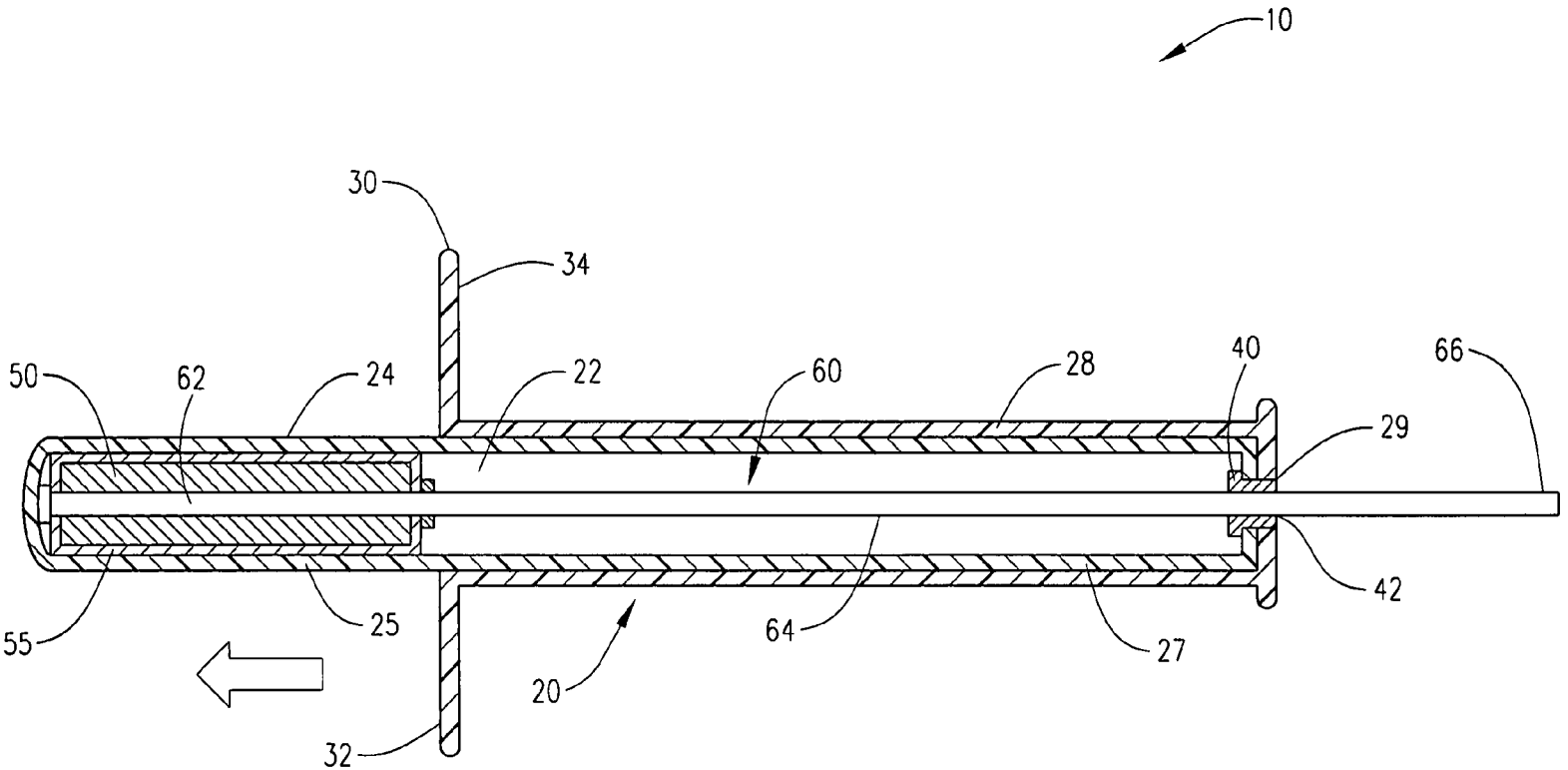
FIG. 2 is a cross sectional view of the magnetic device with the cylindrical bipolar magnet shown in the tool section of the cylindrical housing.

A magnetic separation device 10 to separate non-magnetic components from magnetic components in a wet or dry mixture, as shown in FIGS. 1-5, the device comprising a non-magnetic cylindrical housing 20 defining an inner longitudinal cylindrical channel 22, an outer surface 24, a central radial hilt 30, a closed end tool section 25 and a handle section 27 defining an opening 29 to the inner longitudinal channel 22, a handle section grommet 40 having a central aperture 42, the handle section grommet 40 inserting within the opening 29 of the handle section 27, a drive shaft 60 defining a tool end 62, a cylindrical neck 64 and a drill attaching end 66, the tool end 62 attaching a strong cylindrical bipolar magnet 50 encased within a slip sleeve 55, the slip sleeve 55 slidably engaged within the inner longitudinal cylindrical channel 22, the drill attaching end 66 extending beyond the central aperture 42 of the handle section grommet 40 further secured to a rotary drive apparatus A, FIG. 1, delivering rotation to the 60 drive shaft, the bipolar magnet 50 upon the tool end 62 rotating within the inner longitudinal cylindrical channel 22 of the cylindrical housing 20 and being movable between the tool section 25 and the handle section 27 as drive shaft 60 is pulled or pushed with the neck 64 moving within the central aperture 42 of the grommet 40, the bipolar magnet 50 producing an alternating and rotating magnetic field around the outer surface 24 of the cylindrical housing 20 attracting magnetic components from a mixture of magnetic and non-magnetic particles against the outer surface 24 of the cylindrical housing 20, spinning the particle mixture upon the outer surface 24 of the tool section 25 of the cylindrical housing 20 while the bipolar magnet 50 is positioned within the tool section 25, FIG. 2. This spinning action urges, liberates and releases the non-magnetic particles outward while spinning, grinding and agitating the magnetic particles against one another while rotating upon the outer surface 24, wherein the non-magnetic particles are expelled and collected from the spinning mixture while the magnetic particles remain bound to the outer surface 24 at the tool section 25 of the cylindrical housing 20.

Figure 3:
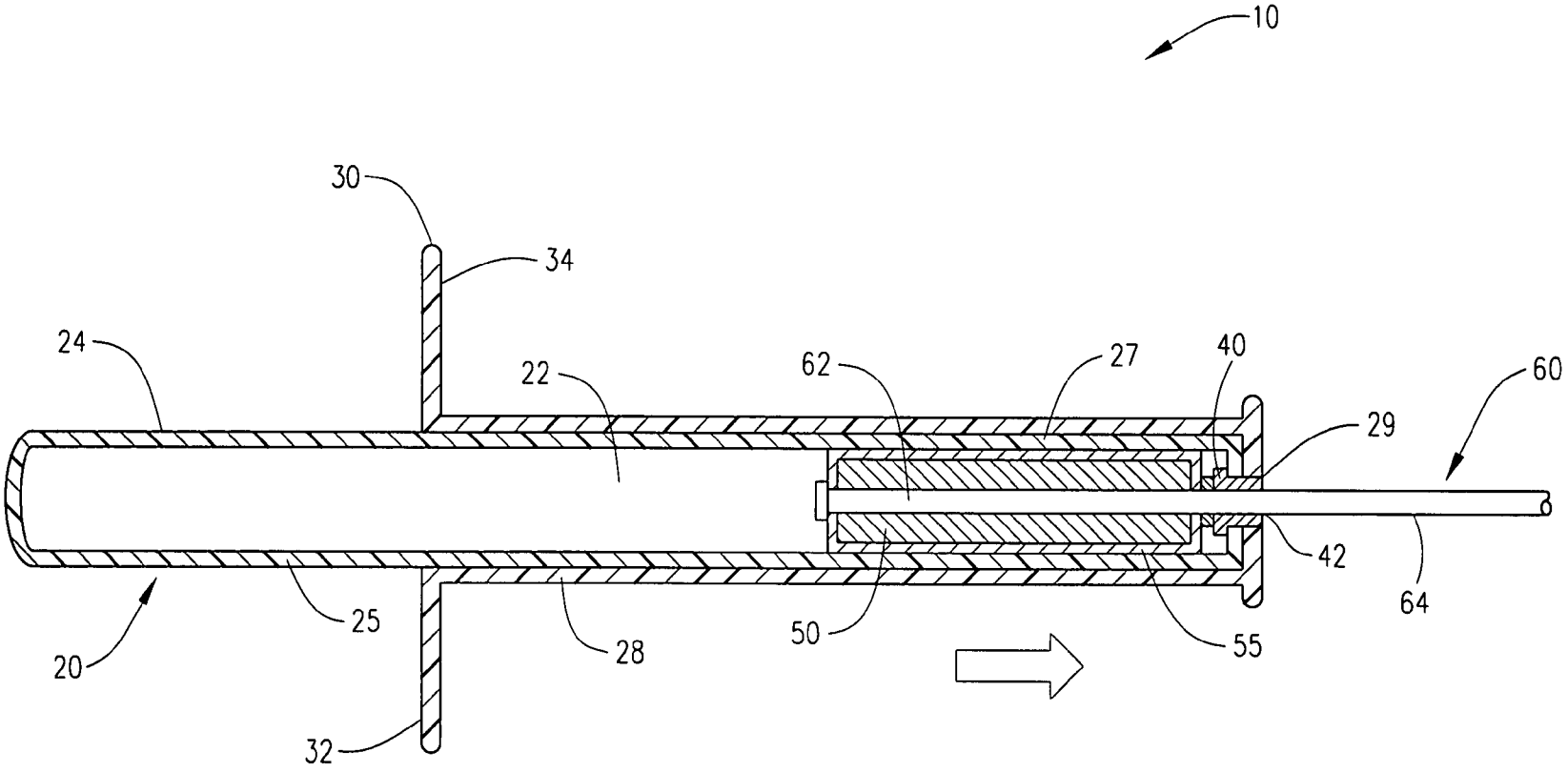
FIG. 3 is a cross sectional view of the magnetic device with the cylindrical bipolar magnet shown in the handle section of the cylindrical housing.

Once the user has cleaned the quantity of mixed materials to their satisfaction, the device 10 is then transferred to a disposal location where the magnetic material is removed from the outer surface 24 of the tool section 25 of the cylindrical tube 20 by withdrawing the bipolar magnet 50 by sliding the drive shaft 60 from the tool section 25 into the handle section 27, FIG. 3, the magnetic material removed from the outer surface 24 as the bipolar magnet 50 is passed by the radial hilt 30 into the handle section 27, withdrawing the magnetic attraction retaining the magnetic material from the tool section 25, the radial hilt 30 blocking the magnetic material from transfer onto the outer surface 24 of the handle section 27 within which the bipolar magnet 50 is now positioned. It would be beneficial for the cylindrical housing 20 to be made of a smooth, non-stick material for ease of removal of the magnetic materials from the tool section 25 during disposal. The device 10 is then ready for further use in processing more of the mixture, or reprocessing the same material for more complete separation by returning the bipolar magnet 50 to the tool section 25 of the cylindrical housing, FIG. 2.

Figure 4:
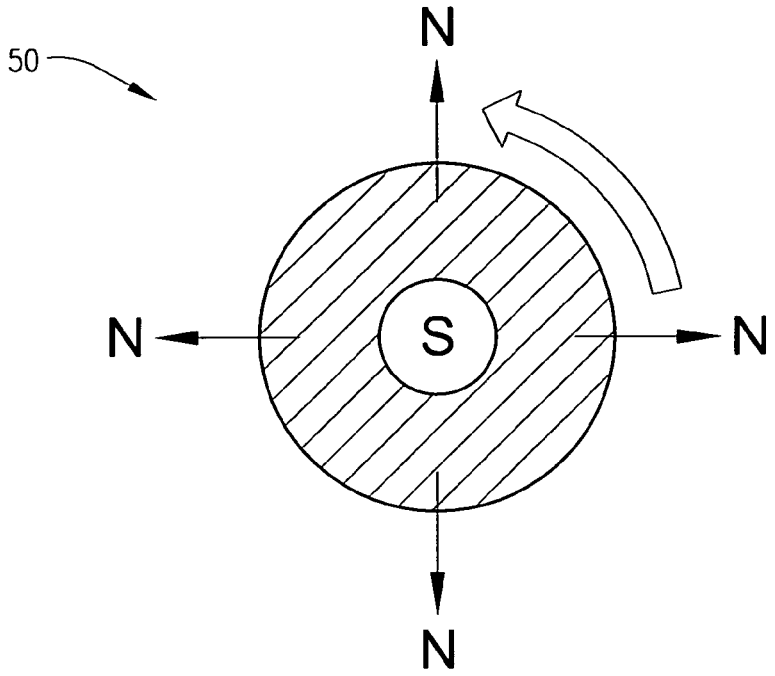
FIG. 4 is a cross sectional view of a first embodiment of the cylindrical bipolar magnet with a radial pole configuration.
Figure 5:
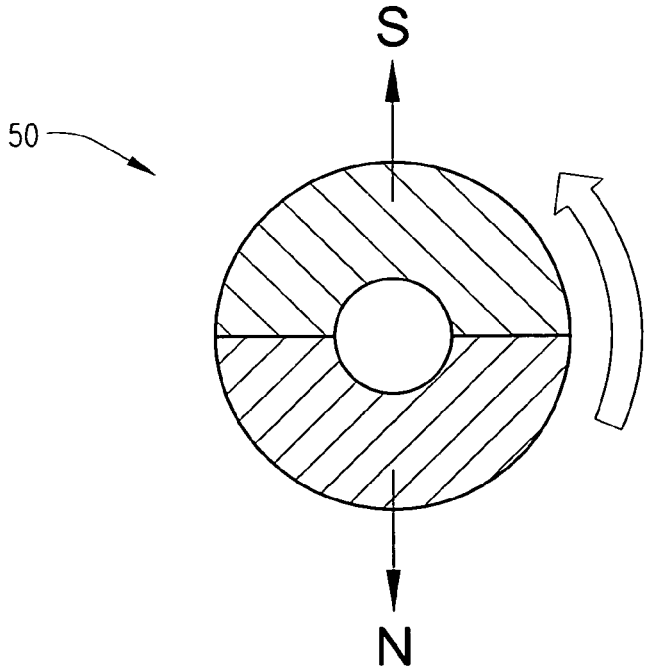
FIG. 5 is a cross sectional view of a second embodiment of the cylindrical bipolar magnet with a diametrical pole configuration.

The slip sleeve 55 surrounding the bipolar magnet 50 is made of a non-magnetic friction reducing material which allows the encased bipolar magnet 50 to rotate and slide freely within the inner longitudinal cylindrical channel 22. The bipolar magnet 50 is a strong earth magnet having a positive portion N and a negative portion S which may be provided in several polar configurations embodiments including a radial polar and a diametric polar configuration, as shown in FIGS. 4 and 5. This bi-polar magnet 50 would configure the positive portion N and negative portion S in a manner which would produce a shifting or alternating magnetic field during rotation. This rotation causes the magnetic particles to also rotate around the outer surface of the cylindrical housing 20 at the same speed as the rotary drive apparatus A would turn the attached drive shaft 60. The higher the rotational speed of the drive shaft 60, the greater the rotational speed of the bipolar magnet 50 and its resulting alternating magnetic field, further causing greater rotation and grinding movement of the magnetic particles, separating the non-magnetic particles from confinement within the magnetic particles and producing a greater amount of rotational force or inertia upon the non-magnetic particles, spinning those non-magnetic particles outward and releasing them from the mixture, preferably into a container for further processing. The retained magnetic particles are then transferred to an appropriate waste disposal container while still attached upon the device 10 and released from the device 10 into the waste disposal container by withdrawing the bipolar magnet 50 within the cylindrical housing 20 from the tool section 25 to the handle section 27 thereby removing the magnetic attraction from the tool section 25.

The radial hilt 30 would be attached to the outer surface 24 of the cylindrical housing 20 along a linear axis between the tool section 25 and the handle section 27 introducing a barrier between the tool section 25 and handle section 27 and also a hand grip stop for the user to hold during operation and use, with the positioning of the radial hilt 30 dependant on the manufactured length desired for the tool section 25. It is contemplated that the radial hilt 30 may be incorporated into a handle section sleeve 28 which inserts over the outer surface 24 of the handle section 27 of the cylindrical housing 20, FIGS. 3 and 4, the handle section sleeve 28 being also made of a non-magnetic material and could also be constructed with the radial hilt 30 as an integrated component. As currently constructed, the tool section 25 beyond the radial hilt 30 is provided in a short version and a long version, with the handle section 27 being provided in both versions at approximately the same size and length. The radial hilt 30 would further provide a tool side surface 32 and a handle side surface 34, with the radial hilt 30 aligning the tool side surface 32 and handle side surface 34 at right angles with the outer surface 24, as shown in FIGS. 2 and 3, for better deterrent to the passage of magnetic materials during withdrawal of the bipolar magnet 50 from the tool section 25 to the handle section 27 of the cylindrical housing 20.

It is contemplated within the scope of this device 10 that its use may be in conjunction with mining and prospecting, ideally suited for use in the separation of black sand mixtures containing precious metals, and also in applications involving plastics and foundries, oil and petroleum refinement, oil and petroleum extraction, chemical and pharmaceutical processing, agricultural and food processing or any other industrial use requiring the separation or extraction of magnetic particles. Additionally, the rotary drive apparatus A may be proportionally sized to the application employed, from as small as the hand held rotary drill shown in FIG. 1, above, to an independent drive mechanism, not shown, which is supplied to the device or provided locally within the industrially application or appliance to compel the required rotational force and speed. A mechanical means, also not shown, may also be provided within a large industrial section to move the magnet from the tool section to the handle section, not under human hand control as is implied in the present device employing the hand held drill of FIG. 1, the handle section 27 alternatively being referenced as a base section, an anchor section, or a dormant section, depending on the size of the magnet, its orientation and the magnitude of the correlating components. It is contemplated that the device 10 may be used in conjunction with other mining and prospecting application, such as incorporation of the device into a trammel, wet or dry sluice, roller cage, swarf, air or water spinning devices, barrels or drums, or into a conveyor drive mechanism, as observed in the prior art and as determined by those skilled in the art who might substitute the novel features of the current device into other technologies.

Additionally, the cylindrical housing 20 is intended to be used as a hand held device, held in one hand against the handle side surface 34 by the handle section 27, with the other hand being used to operate the rotary drive apparatus A while controlling the position location of the bipolar magnet 50 within the longitudinal cylindrical channel 22. It is essential that the cylindrical housing 20 be of an appropriate circumference to be comfortably and securely held by a user. Thus, the cylindrical housing 20 may be presented in more than one circumference for the comfort to various users, with the bipolar magnet 50 and other components accordingly sized to maintain the intended function of the device 10.

The cylindrical bi-polar magnet 50 would preferably be no longer than the length of the tool section 25, the tool side surface 32 of the radial hilt 30 imposing a separation barrier between the tool section 25 of the cylindrical housing 20 and the handle section 27 of the cylindrical housing 20, while completely withdrawing any magnetic attraction to the tool section 25 when the bipolar magnet 50 is completely withdrawn into the handle section 27 to release the magnetic particles from the tool section 25, FIG. 3. Without the radial hilt 30, the magnetic particles would simply pass along the cylindrical housing 20 without the ability to release the magnetic particles from the cylindrical housing 20. With the inclusion of the radial hilt 50, the attracted and attached magnetic particles are prevented from passing along the cylindrical housing 20 and, when the bipolar magnet 50 is withdrawn past the radial hilt 30, the magnetic particles are released and fall away from the outer surface 24 of the cylindrical housing 20.

While the separation device 10 has been particularly shown and described with reference to a preferred embodiment thereof, it will be understood by those skilled in the art that changes in form and detail may be made therein without departing from the spirit and scope of the invention.

What is claimed is:

1. A magnetic separation device to separate non-magnetic particles from magnetic particles in a wet or dry mixture containing precious and valuable metal ores, said device comprising:

a non-magnetic cylindrical housing defining an inner longitudinal cylindrical channel, an outer surface, a closed end tool section and a handle section defining an opening to said inner longitudinal channel;

a non-magnetic radial hilt applied along said outer surface upon said cylindrical housing;

a handle section grommet having a central aperture, said handle section grommet inserting within said opening of said open handle section;

a drive shaft defining a tool end, a cylindrical neck and a drill attaching end;

a strong cylindrical bipolar magnet attaching to said tool end of said drive shaft, said bipolar magnet encased within a friction reducing, non-conductive slip sleeve, said slip sleeve slidably engaged within said inner longitudinal cylindrical channel, said drill attaching end extending through said central aperture beyond said handle section grommet with said cylindrical neck in sliding engagement within said central aperture, said drill attaching end further secured to a rotary drive apparatus delivering rotation to said drive shaft, said bipolar magnet upon said magnetic end rotating within said cylindrical housing and being movable between said tool section and said handle section as said drive shaft is extended or withdrawn within said longitudinal cylindrical channel, said rotating bipolar magnet producing a strong alternating and rotating magnetic field around said outer surface of said cylindrical housing, attracting and spinning said magnetic particles within said mixture of magnetic and non-magnetic particles upon said outer surface of said cylindrical housing, said spinning and rotation casting away said non-magnetic particles for collection as said magnetic particles remain bound to said outer surface of said tool section of said cylindrical shaft, said magnetic particles released from said tool end by withdrawal of said bipolar magnet from said tool end into said handle end.

2. The magnetic separation device as disclosed in claim 1, wherein said outer surface of said cylindrical housing is a smooth and non-stick surface for ease of and complete removal of said magnetic materials from said tool section upon completion of said separation.

3. The magnetic separation device as disclosed in claim 1, further comprising:

said bi-polar magnet is a strong radial polar earth magnet having a positive portion and a negative portion which produce a shifting and alternating magnetic field during rotation, said rotation causing said magnetic particles to attach to and rotate around said outer surface of said cylindrical housing at the same speed as said rotary drive apparatus turns said attached drive shaft; and said bi-polar magnet having a length no longer than said tool section, said radial hilt imposing a separation barrier between said tool section and said handle section, preventing said magnetic particles from transfer onto said handle section of said handle section of said cylindrical housing and completely withdrawing any magnetic attraction produced by said bipolar magnet from said tool section when said bipolar magnet is completely withdrawn into said handle section when removing said magnetic particles from said tool section.

4. The magnetic separation device as disclosed in claim 1, further comprising:

said bi-polar magnet is a strong diametric polar earth magnet having a positive portion and a negative portion which produce a shifting and alternating magnetic field during rotation, said rotation causing said magnetic particles to rotate around said outer surface of said cylindrical housing at the same speed as said rotary drive apparatus turns said attached drive shaft; and said bi-polar magnet having a length no longer than said tool section, said radial hilt imposing a separation barrier between said tool section and said handle section, preventing said magnetic particles from transfer onto said handle section of said handle section of said cylindrical housing and completely withdrawing any magnetic attraction produced by said bipolar magnet from said tool section when said bipolar magnet is completely withdrawn into said handle section when removing said magnetic particles from said tool section.

5. The magnetic separation device as disclosed in claim 1, further comprising:

said radial hilt is integrated into a handle section sleeve inserting over said outer surface of said handle section of said cylindrical housing, said handle section sleeve also being made of a non-magnetic material.

6. The magnetic separation device as disclosed in claim 1, said radial hilt further comprising:

a tool side surface and a handle side surface, said radial hilt aligning said tool side surface and said handle side surface at right angles with said outer surface as an enhanced deterrent to transfer of said magnetic particles during withdrawal of said bipolar magnet from said tool section to said handle section of said cylindrical housing, wherein said magnetic particles upon said outer surface of said tool end of said cylindrical housing are prohibited from passing along said cylindrical housing when said bipolar magnet is withdrawn past said tool side surface of said radial hilt, said magnetic particles further released from said tool section of said outer surface of said cylindrical housing.

7. The magnetic separation device as disclosed in claim 1, further comprising:

said device is proportioned for use as a hand held device and said cylindrical housing is of a circumference to be held within one hand of a user against said radial hilt while another hand of said user operates said rotary drive apparatus and positions said bipolar magnet within said inner cylindrical channel.

8. The magnetic separation device as disclosed in claim 1, wherein said device is employed in large scale industrial application or appliance, including a mechanical means to withdraw the drive shaft and the attached bipolar magnet from the tool section into the handle section and wherein said rotary drive apparatus is suited for said industrial application and supplied to said device or available locally within said industrially application or appliance to compel said drive shaft and bipolar magnet with the required rotational force and speed suited for said industrial application or appliance.

* * * * *